United States Patent [19]

Pfotenhauer

[11] 3,948,513

[45] Apr. 6, 1976

[54] APPARATUS FOR POLYMETRICALLY DEVELOPING MUSCALUTURE AND MAINTAINING PHYSICAL FITNESS

[76] Inventor: James Michael Pfotenhauer, 1302 N. 19th St., Escanaba, Mich. 49829

[22] Filed: May 6, 1974

[21] Appl. No.: 467,589

[52] U.S. Cl. ..... 272/58; 272/81; 272/62; 272/84 R

[51] Int. Cl.[2] ..... A63B 17/00

[58] Field of Search ..... 272/58, 60 R, 81; 182/117, 182/118, 119, 178, 179, 183

[56] References Cited

UNITED STATES PATENTS

| | | | |
|---|---|---|---|
| 239,970 | 4/1881 | Medart | 272/60 R |
| 316,643 | 4/1885 | Niehaus | 182/118 |
| 591,208 | 10/1897 | Carrick | 182/183 |
| 1,582,487 | 4/1926 | Shank | 272/79 R |
| 3,010,720 | 11/1961 | Allard | 272/60 R |
| 3,071,204 | 1/1963 | Piltingsrud | 182/179 |
| 3,396,817 | 8/1968 | Perry | 182/179 |
| 3,556,254 | 1/1971 | Lambert | 272/66 |
| 3,735,979 | 5/1973 | Levenberg | 272/58 |

FOREIGN PATENTS OR APPLICATIONS

| | | | |
|---|---|---|---|
| 1,420,610 | 1965 | France | 272/81 |

*Primary Examiner*—Richard C. Pinkham
*Assistant Examiner*—Joseph R. Taylor
*Attorney, Agent, or Firm*—Burns, Doane, Swecker & Mathis

[57] ABSTRACT

An element of exercising apparatus intended to support the body of a user and equipment being manipulated has upstanding, mutually parallel legs interconnected by a body supporting platform. Opposed ends of the platform are independently adjustably and disconnectably connected at selected locations along the length of the legs. Equipment supporting rails extend between opposed legs and are adjustably and disconnectably connected thereto. An element of exercising apparatus intended to be manipulated by a user is comprised of a central column from which a plurality of supportive members rigidly radiate. A weight retaining column extends from each supportive member in parallel relation to the central column. A lifting arrangement is adjustably connected to the central column to enable a user to lift the apparatus. A method of exercising can be engaged in using the exercising apparatus by initially resting on the body supporting platform and manipulating weighted equipment in an exercising routine. After moving clear of the exercising apparatus and inverting the element intended to support the body of a user and the equipment being manipulated, the user can again rest on the body supporting platform and manipulate the weighted equipment in another exercising routine.

10 Claims, 21 Drawing Figures

FIG. 4
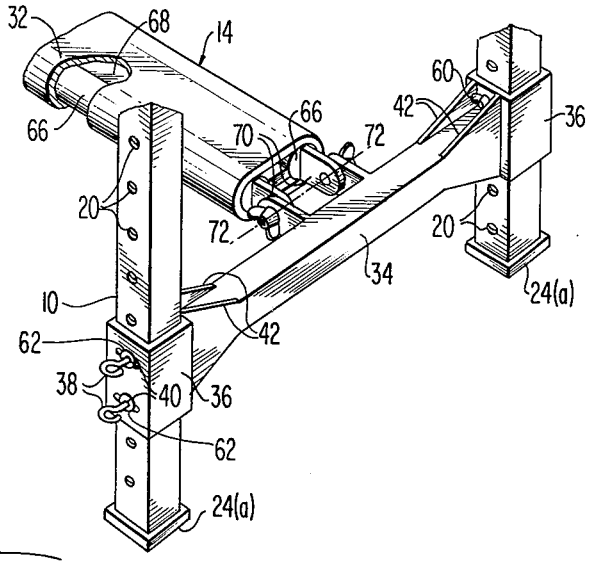
FIG. 5
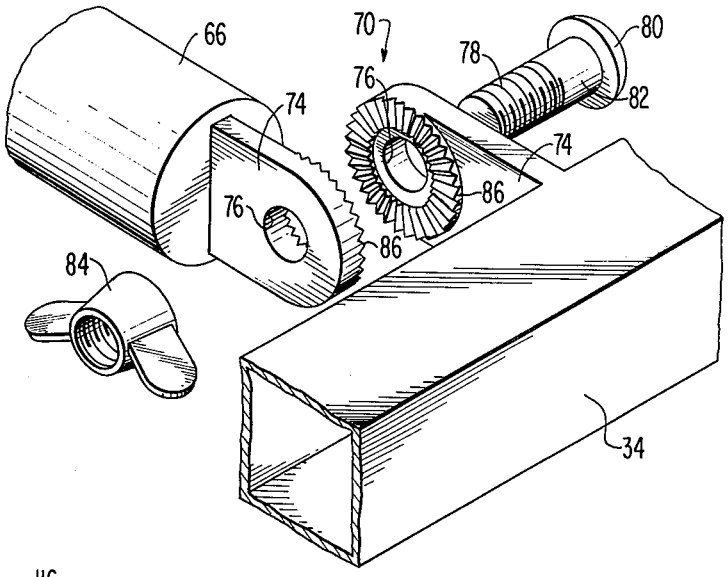
FIG. 7
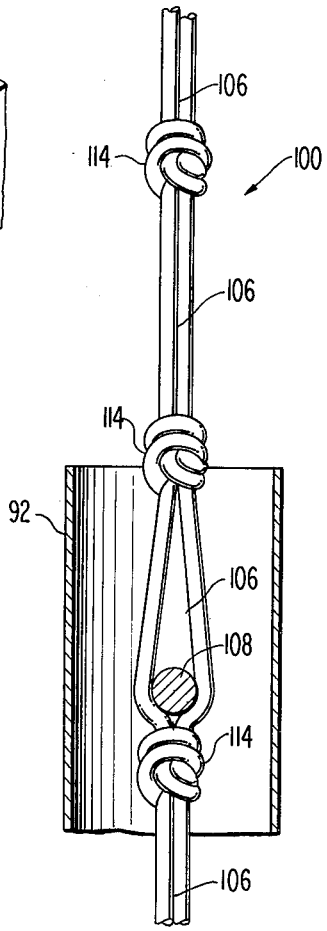
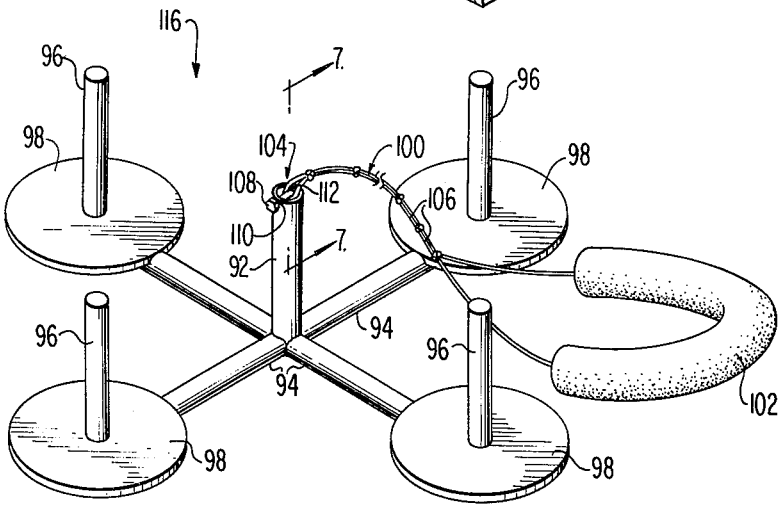
FIG. 6

FIG. 8a
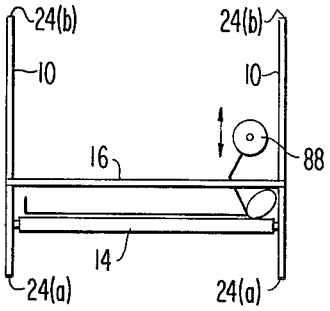
FIG. 8b
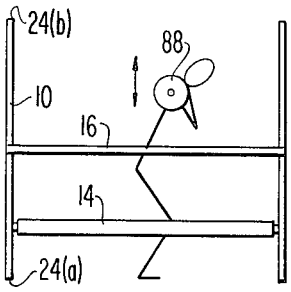
FIG. 8c
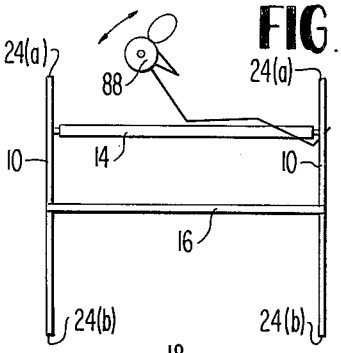
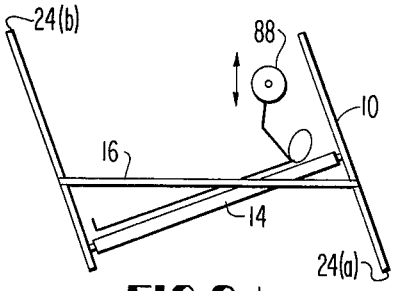
FIG. 8d
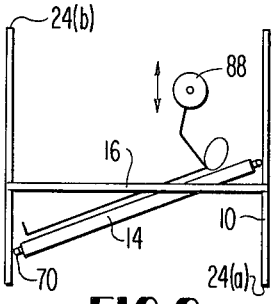
FIG. 8e
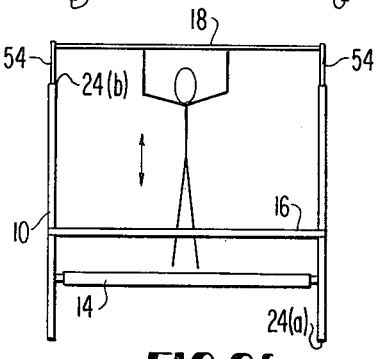
FIG. 8f
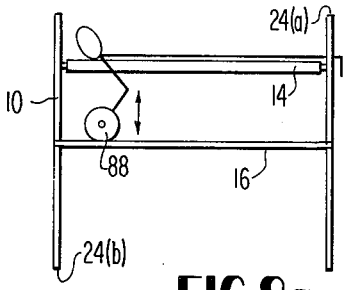
FIG. 8g
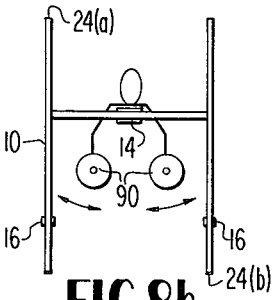
FIG. 8h
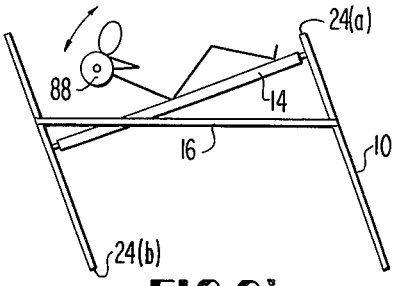
FIG. 8i
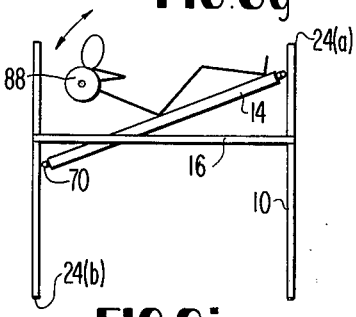
FIG. 8j
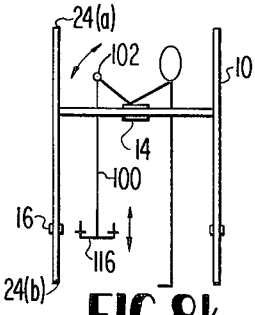
FIG. 8k
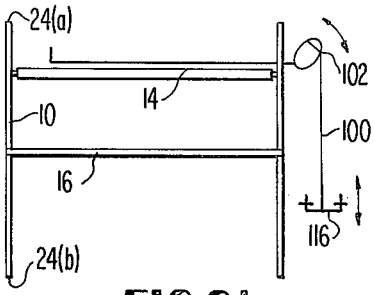
FIG. 8l
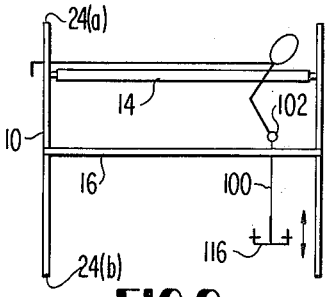
FIG. 8m
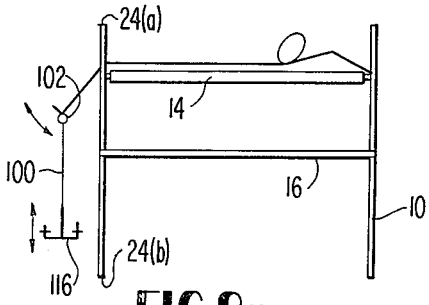
FIG. 8n

APPARATUS FOR POLYMETRICALLY DEVELOPING MUSCALUTURE AND MAINTAINING PHYSICAL FITNESS

BACKGROUND AND FIELD OF THE INVENTION

This invention relates generally to an exercising method and apparatus for polymetrically, as opposed to isometrically, developing the human musculature and maintaining human physical fitness. More particularly, this invention relates to an apparatus which is highly versatile in the number and types of exercises which can be performed using it and which is fully portable and amenable to complete and easy disassembly. This invention further relates to methods of exercising as applied to the exercising apparatus.

It has been established beyond any serious argument that the human body should undergo a regular regimen of exercise in order to maintain a person's good physical and mental health and to afford proper muscular development. Disease of the cardiovascular system, for instance, poses a major health problem in the United States. Other health problems include those constituting a physical manifestation of conditions of mental stress such as frustration and worry incident to the strenuous pace of modern living. Another problem resides in the need to maintain a feeling and appearance of physical wellbeing. Physical exercise is often quite helpful in alleviating such problems. Exercise can maintain the human body trim and physically fit and can allow mental relaxation while a person is engaged in an enjoyable diversion which can provide an outlet for his frustrations.

In the not too distant past, rigorous physical exercise formed an inherent part of human life. The population of this country in particular was located largely in rural areas and the economy was predominantly agrarian. The farm work associated with earning a livelihood provided more than enough exercise and the life style was significantly more relaxed than under present circumstances. The urban population was quite centralized and most people could walk to work. Furthermore, once at work most people were engaged in largely stress free physical tasks which provided adequate exercise for general physical fitness.

With the advent of industrialization, life has become increasingly sedentary. The rural segment of the population now constitutes only a fraction of the total and farming activities have become highly mechanized. Urban centers have become quite large and people must now commute to work. Once at work, the activity in which they engage has become significantly more stressful and at the same time less physical. Furthermore, due to the more hectic pace of modern life and the fact that people must now commute to work, significantly less time is available for any extra physical exercise.

Nonetheless, in recognition of problems caused by a lack of physical exercise, many people have attempted self imposed regimens of physical exercise. These persons are often confronted with the problem that they lack the facilities or personnel to develop a satisfactory program of exercise. For instance, the absence of any suitable open and safe areas may render jogging impractical. Jogging may also be undesirable since it constitutes a relatively specialized activity. Swimming may be impractical because of its seasonal character in many parts of the United States and because of the need for a pool. Other activities such as team sports, of course, require a number of individuals. It may be impractical to convene such a group in light of busy and often conflicting schedules. Even activities such as tennis squash, racket ball, or handball require at least one other person to provide a satisfactory regimen of exercise.

The problems suggested above have led some individuals to a regimen of exercise comprised of weight lifting. As presently constituted, however, weight lifting may suffer from a number of the problems suggested above. For example, in order to engage in a satisfactorily complete regimen of weight lifting exercises, considerable amounts of equipment are needed. An individual needs at least barbells and dumbbells, a bench for bench presses, a power rack for power squats, an inclined bench for sit-ups, and a chinning bar for chinnups and for stretching and relaxing heavily exercised muscles after a given weight lifting routine. Such a formidable array of equipment may also render any complete regimen of physical exercise relatively time consuming. For instance, adjustments may be needed to various pieces of equipment, and the weights, i.e., the barbells and/or dumbbells, must be transferred from one piece of equipment to another as the regimen or sequence of exercises is conducted. Finally, because equipment of the type used in weight lifting is normally produced in limited numbers and because it must be inordinately sturdy, such equipment is often quite expensive with regard to both capital cost and the cost of maintenance.

If a person has easy access to a gymnasium, these problems are not so significant. However, it can be readily appreciated that it may be inconvenient, expensive, or impossible for most individuals to go to a gym in order to use the equipment mentioned above. This would be particularly true if a person's only free time is in the evening. It is also unfortunately the case that the numerous pieces of equipment which may be required in all likelihood would occupy too much space to be amenable to use in the private home. A person exercising in his home would normally do so in the basement or garage and space in these areas is often quite limited. It can thus be appreciated that the need for multiple pieces of equipment may render it impossible for most individuals to enjoy a complete regimen of physical exercise by engaging in weight lifting.

The requirement of multiple pieces of equipment also presents a problem with regard to storage and portability in the event the equipment is to be taken out of use. Furthermore, many of the pieces of equipment used in weight lifting may not be self-supporting and may thus require that portions of the equipment be fastened to the floor and/or ceiling of the room where it is used. This may be impractical and/or quite undesirable in the modern home.

A number of attempts have been made to meet the problems suggested in the preceding. These attempts have not, however, been altogether successful. For instance, as the preceding discussion suggests, it is highly important that a person be able to engage in a full spectrum of exercises performed using barbells and dumbbells in order to enjoy the complete regimen of physical exercise necessary for well rounded physical development and complete physical fitness. Many of the exercises, for instance, may be engaged in a standing position. Others, however, require that the individual assume prone, supine, sitting, or suspended postures. Therefore, bearing in mind restrictions imposed by limitations in space and a person's time, and the need for portability, equipment used in weight lifting should be highly versatile to allow the user to perform a full spectrum of exercising routines. Many devices in the prior art, while perhaps advantageous in some respects, are simply not sufficiently versatile to enable a user to perform a full regimen or sequence of exercises.

To be conveniently in a modern home weight lifting equipment should not be only highly versatile, compact, and portable, but it should be sufficiently stable to be self-supporting as well. In most modern homes, for instance, it would not be satisfactory from an aesthetic or structural standpoint to fasten unstable pieces of equipment to the floor and/or ceiling. In this regard, many devices of the prior art, while perhaps somewhat versatile and/or compact and portable, may depend for stability on being fixed to the floor and/or ceiling.

Other devices of the prior art while perhaps compact or stable and fairly versatile, may be unduly complex and heavy. These devices may not be readily moved or disassembled if the device is to be taken out of use or otherwise moved. Given the relatively small character of modern homes and the transient nature of the population, a piece of equipment which cannot be easily moved or disassembled suffers a significant disadvantage. Conversely, if a device of the prior art is sufficiently small and simple to be readily portable or disassembled it may not be sufficiently versatile to meet the needs of a person desiring a complete regimen of physical exercise.

A further approach to the problems suggested above, in connection with multiple pieces of equipment and the requirements regarding space and convenience, has been to construct a single, relatively compact, readily adjustable machine. Such a machine often includes a plurality of hand grips or other arrangements against which the user can exert force to lift weights contained within the device. While compact and somewhat versatile, machines of this type suffer the serious disadvantage thay they may be complex and therefore extremely costly and vulnerable to maintenance problems. In addition, though the single piece of equipment may be rather compact relative to the space otherwise occupied by the several pieces of equipment required to serve the same function, the single piece of equipment may still be large, quite heavy, and therefore not portable. Furthermore, the complexity of such a piece of equipment may render it difficult to disassemble for transportation and/or storage. These devices may also suffer from the highly significant problem that since the movement of the weights may be constrained by the configuration of the machine, the user does not develop any muscular coordination and control as he would if he were using freely movable barbells and/or dumbbells.

The problems suggested in the preceding, while not exhaustive, are among many which may tend to reduce the effectiveness and desirability of known methods and equipment used in weight lifting exercises. Other noteworthy problems may also exist; however, those presented in the discussion above should be sufficient to demonstrate that the methods of exercising and the weight lifting equipment appearing in the prior art have not been entirely satisfactory, particularly with regard to the versatility, stability, and portability of the equipment.

OBJECTS AND SUMMARY OF THE PREFERRED FORM OF THE INVENTION

In light of the foregoing it is therefore a general object of the invention to provide a novel apparatus intended to obviate or minimize the problems of the type noted.

It is a particular object of the invention to provide a novel apparatus for developing the musculature and maintaining the physical fitness of a user which is highly versatile and suitable for use in connection with exercises performed in standing, prone, supine, sitting, or suspended postures.

It is another object of the invention to provide a method and apparatus for developing the musculature and maintaining the physical fitness of a user wherein the equipment used is sufficiently stable to be self-supporting without being fixed to the floor or ceiling of the room in which it is used.

It is still another object of the invention to provide a novel apparatus for developing the musculature and maintaining the physical fitness of a user wherein the equipment used is readily portable and easily disassembled if the equipment is to be taken out of use and stored or moved.

It is still another object of the invention to provide a novel apparatus for developing the musculature and maintaining the physical fitness of a user wherein the equipment used is compact and quite simple in construction and operation.

An exercising method and apparatus for polymetrically developing the musculature and maintaining the physical fitness of a user intended to obviate or minimize problems of the type discussed in the preceding is comprised of upstanding, mutually parallel, elongated legs which are rested on a suitable datum plane such as a floor. The legs are arranged in opposed coplanar pairs so that each leg will coincide with an apex of a circumscribing rectangle. Opposite ends of a body supporting platform are independently adjustably and disconnectably connected along the length of the legs so that the body of the user can be supported at selected elevations and orientations relative to the datum plane. The ends of the body supporting platform are connected to selected locations along the length of the legs by first connecting fixtures. Equipment supporting rails are independently adjustably and disconnectably connected along the length of the legs in spaced relation to the body supporting platform to support at selected elevations relative to the datum plane, the equipment to be manipulated by the person exercising. Each end of each rail is connected to selected locations along the length of the legs by second connecting fixtures.

Operably associated with the legs, body supporting platform, equipment supporting rails, and the connecting fixtures is a further element of the invention comprised of a central column from which a plurality of supportive members rigidly and orthogonally radiate. Opposite the end of each supportive member connected to the central column is disposed a slender retaining column which is inserted through the central apertures of disc weights which are employed to load the exercising apparatus. The retaining columns insure that the disc weights will remain in a fixed position relative to the central column. Adjustably connected to the central column is a harness and tether arrangement which enables the user to lift and manipulate the exercising apparatus relative to the legs, body supporting platform, equipment supporting rails, and connecting fixtures.

Exercising routines can be performed according to the present invention by initially resting at least a portion of one's body upon the body supporting platform and manipulating weighted equipment relative to the legs, body supporting platform, equipment supporting rails, and connecting fixtures in an exercising routine. Once the routine is completed and the exercising apparatus has been inverted from a normal position 180° relative to the datum plane, one can then again rest one's body on the body supporting means and weighted equipment can be manipulated in another exercising routine without adjusting the connection to the legs of the body supporting platform or the equipment supporting rails.

THE DRAWINGS

Other objects and advantages of the present invention will become apparent with reference to the detailed description to follow of a preferred embodiment thereof wherein like reference numerals have been applied to like elements in which:

FIG. 4 illustrates a partial perspective view of an alternative embodiment of an element of the invention showing the portion of the invention intended to support the body of a user as pivotally connected to remaining portions thereof;

FIG. 5 illustrates as exploded perspective view of a preferred pivotal connection which may be employed to connect the portion of the invention intended to support the body of a user to remaining portions thereof;

FIG. 6 illustrates a perspective view of an embodiment of an element of the invention intended to be lifted and manipulated by a user in the course of an exercising routine;

FIG. 7 illustrates a partial cross-sectional view of the invention taken along line 7-7 of FIG. 6; and FIGS. 8A–8N illustrate, schematically, exercising methods which may be employed according to the present invention to develop the musculature and maintain the physical fitness of a user.

DETAILED DESCRIPTION

Figure 1:
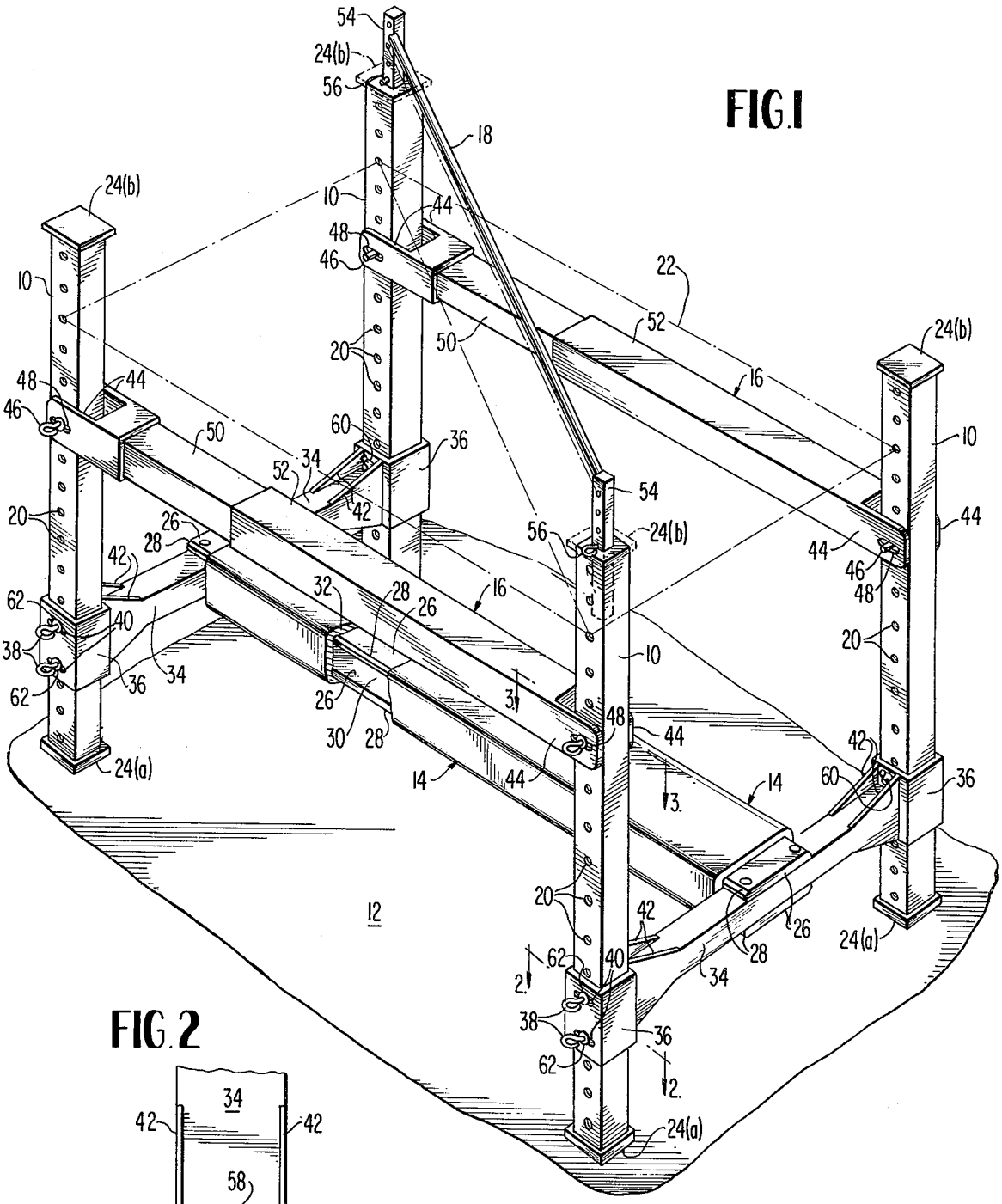
FIG. 1 illustrates a perspective view of an embodiment of an element of the invention intended to support the body of a person exercising and equipment to be manipulated during an exercising routine.

Referring now to FIG. 1, a perspective view can be seen of an embodiment of an element of the invention intended during an exercising routine to support the body of a person exercising and the equipment to be manipulated. Four generally vertical, supportive legs 10 can be seen as they are supported by a suitable datum plane 12, such as a floor or the ground. A body supporting means in the form of a fully padded platform 14 is connected to the legs to support the body of a user. Two opposed parallel equipment supporting means in the form of telescoping rails 16 are also connected to the legs 10 in spaced relation to the padded platform 14. A horizontally oriented bar 18 to be used during chinning exercises extends diagonally between two opposed coplanar legs.

The legs 10 are arranged in opposed coplanar pairs to coincide with the apices of a circumscribing rectangle. That is, each leg is and remains parallel to each of the remaining three legs and thus would coincide with an apex of a rectangle which would circumscribe all four legs. As will be more fully described in connection with the discussion of FIG. 8, the legs may on occasion be inclined relative to the datum plane 12 but nonetheless the legs remain mutually parallel.

Plural periodic apertures 20 are disposed in each leg 10 in opposed, laterally registering relation between adjacent as well as diagonally opposite legs. As will be more fully described in subsequent discussion, these apertures are employed in the support of the equipment supporting rails 16 and the body supporting platform 14 in relation to the legs. The apertures must register horizontally in order to insure that the padded platform and the rails can be arranged, if desired, at appropriate elevations and in parallel relation to one another. The horizontal registry of the apertures 20 can be seen schematically from the dashed line located at 22 which defines a plane oriented parallel to the datum plane 12.

The legs 10 are preferably fabricated from a tubular material and may be either cylindrical or square as shown depending upon which form is preferred or more readily available. The legs, whether cylindrical or square in section, are capped at each end by caps **24*a* and 24*b* which may be composed of plastic, rubber, and/or any other suitable material. The caps serve to prevent damage to any surface upon which the exercising apparatus might rest and also serve to minimize the possibility that the exercising apparatus might slide too easily along the floor. As can be clearly seen from FIG. 1, the caps are arranged to cover the opposed, essentially coplanar ends of the legs and thereby provide first and second means for engaging a ground surface such as the datum plane 12 during different exercising routines. For instance, during one routine, the exercising apparatus might assume the normal orientation illustrated in FIG. 1. During another routine the exercising apparatus might assume an inverted orientation. This aspect of the invention will be more fully described in connection with the discussion of FIG. 8; however, it is convenient to note at this point that the apparatus is invertible and that in either case the legs 10** will engage the surface upon which they rest in a manner which will prevent damage to the surface and minimize the possibility of sliding.

The body supporting means takes the form of an elongated padded platform 14 which extends between opposed, coplanar pairs of legs to support the body of a user while an exercising routine is being performed. By means of the platform 14, the body of the user can be supported at a variety of selected elevations and in a number of orientations relative to the datum plane 12. In this regard it will be appreciated that the platform 14 can be readily elevated or inclined to enable a user to assume a variety of postures and to perform a relatively great variety of exercising routines. For instance a user can assume a prone, supine, inclined or a sitting position on the platform during an exercising routine. The particular manner in which the platform is connected to the legs 10 and thereby positioned along the length thereof will be more fully described in the course of subsequent discussion.

The platform can be constructed of any of a variety of materials in a number of configurations. In a preferred form, however, the platform is constructed from two, generally parallel, coextensive planar member 26 which can, of course, be fabricated from any structurally adequate material. The outer edges of the planar members 26 are radiused or chamfered as at 28 to avoid causing discomfort to the user. To enhance the rigidity of the planar members 26, one or more lengths of structural tubing could be intercalated therebetween in the space indicated at 30 and secured to the planar members 26. Similarly, one or more lengths of angle iron could be secured to the planar members in a like manner.

The platform 14 is fully padded by a heavy sheet of padding 32 wrapped around the planar members 26 to insure the comfort of a person resting on the platform. The fully padded character of the platform compliments the versatility of the exercising apparatus in that because of the invertibility of the apparatus a user can comfortably rest his body on either side of platform 14.

The width of the platform 14 should preferably be narrower than the width of a typical user's back, as measured between the shoulder joints. This relatively narrow width contributes to the comfort of a user during a number of exercises. For instance, should a user be engaged in an exercise commonly referred to as a bench press, he might rest in a prone position on the platform and proceed to cyclically lower a barbell toward his chest and then push the barbell away. As the user lowers the barbell toward his chest in the course of such an exercise, the cleavage in his back increases and his upper arms and shoulders move dorsally. If the width of the bench is slightly narrower than the width of the user's back as measured between the shoulder joints, the arms and shoulders will be free to comfortably move dorsally as the bar of the barbell approaches the user's chest. Otherwise, the user's upper arms and shoulders may chafe against or be obstructed by the platform.

Rigidly and transversely connected to each end of the platform 14 and forming an integral part of the body supporting means is a transverse member 34 preferably of structural tubing. The transverse members may be connected to the platform as shown, by extending the planar members 26 over a portion of the transverse members 34 and by bolting the members together. If the planar members are reinforced by one or more lengths of intercalated structural tubing or angle iron, these reinforcing members can be secured to the transverse members in any desired manner. However, in whatever manner these intercalated reinforcing members are connected to the transverse members, it is preferred that the connection be removable.

Both ends of the platform 14 are independently adjustably and disconnectably connected to the legs 10 at selected locations along the length thereof by suitable first connecting means. The first connecting means preferably take the form of apertured collars 36 and associated cylindrical fasteners 38. A collar 36 is rigidly connected to each end of each transverse member 34 and closely surrounds a leg 10 in sliding relation therewith. The cylindrical fasteners 38 are elongated cylindrical members which may be inserted through apertures 40 in each collar and apertures 20 in a leg which register with the apertures in the collar to fix the collar longitudinally relative to the leg.

Any apertures in each collar are preferably spaced to register concurrently with a like number of apertures disposed in the leg surrounded by the collar. The apertures in the collar are generally elliptical, as can be seen from FIG. 2, to insure registry with the apertures 20 in a leg and to facilitate the insertion of the cylindrical members 38.

Figure 2:
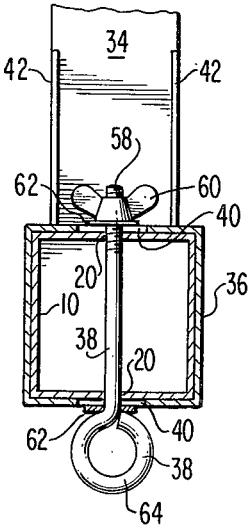
FIG. 2 illustrates a horizontal cross-sectional view of a portion of the invention as taken along the line 2—2 of FIG. 1.

The elongated cylindrical members can take any appropriate form, though the threaded fastener, wing nut, and washer arrangement illustrated in FIG. 2 is preferred. The cylindrical members 38 might alternatively be comprised of simple cylindrical pins each having a right angle bend at one end and a washer at the other end. Such a pin could simply be inserted through the apertures and then turned so that the right angle bend could prevent the pin from slipping out of the apertures. In any case, it should be noted that each collar 36 is of sufficient length that the end of a cylindrical member 38 will clear the transverse member 34 upon insertion through the apertures 20 and 40. It will be noted as well that each collar 36 is braced relative to the transverse member 34 to which it is connected by flanges 42.

It should be readily apparent at this point that the sliding apertured collar and cylindrical fastener arrangement described in the preceding provides a highly convenient arrangement whereby the elevation or inclination of the platform 14 can be adjusted at will. Furthermore, by removing the floor protecting caps, the platform can be entirely removed from the legs to facilitate storage or shipping.

It should be emphasized at this point that any suitable connecting means capable of functioning as described in the preceding could be employed to connect the platform to the legs, so long as opposed ends of the platform are independently adjustably and disconnectably connected to the legs. For instance, a simple apertured strap could be configured to extend from each end of a transverse member 34 to wrap around and thereby surround a leg on three sides. The strap could be welded or bolted to a transverse member as desired.

The equipment supporting means takes the form of parallel, longitudinally telescoping rails 16 which extend between coplanar legs of opposed coplanar pairs. The rails 16 support at selected elevations relative to the datum plane equipment to be manipulated by a user. A yoke 44 is disposed at each end of each rail to partially surround the legs and, in conjunction with a cylindrical fastener 46, to connect the rail to the leg. Elliptical apertures 48 similar to those disposed in the apertured collars 36 are disposed in the yoke 44 and extend transversely therethrough to permit convenient insertion of the cylindrical fasteners 46, through the elliptical apertures 48 and the apertures 20 disposed in the legs. The cylindrical fasteners in this case preferably take the form of simple cylindrical pins which are not threaded and which are simply slipped in and out of the apertures to connect the rails to the legs. The yoke and pin arrangement thereby constitute second connecting means through which the rails 16 are independently adjustably and disconnectably connected at each end to selected locations along the length of the legs.

As will be more fully appreciated from the examination of FIG. 8 and the discussion thereof to follow, the adjustability of the bars allows equipment, such as barbells, to be conveniently supported at desired elevations relative to the datum plane 12, in spaced relation to the platform 14 and the body of a user. For instance, if a user is performing a bench press routine, the rail 16 should be placed relatively close to the bench so that when the user assumes a supine position on the platform 14, he can conveniently grasp the bar of the barbell and push the barbell away from his chest. If power squats are to be performed, however, the rails may need to be adjusted to a different position so that when the barbells are rested on the rails, the person exercising can get under the bar of the barbell to position it on his shoulders near the nape of his neck.

It should be emphasized that the rails 16 are telescoping by virtue of the provision of an inner member 50 which slides longitudinally within an outer member 52. The capacity of the rails 16 to telescope and thereby lengthen and shorten is necessary to permit the platform 14 to be inclined relative to the datum plane. It should be readily apparent that if the platform is to be inclined relative to the datum plane the rails 15 must vary in length in order to remain level to support the equipment to be manipulated by the user. The flexibility in length is required regardless of whether the platform is rigidly connected to the transverse members 34 or pivotally connected thereto as illustrated in FIG. 4. In the case of a rigid connection, the rails must generally lengthen as the platform is moved from a horizontal to an inclined posture relative to the datum plane. However, if the platform is pivotally connected to the transverse members, the rails must generally shorten as the platform is inclined. This phenomenon will be more fully discussed in connection with FIG. 8. The need for the telescoping capability, however, can be readily appreciated for present purposes from an examination of FIGS. 8*d*, 8*b*, 8*i*, or 8*j*.

A chinning bar is provided in the form of the horizontally oriented bar 18 which extends between and is connected to opposed coplanar legs. The ends of the bar 18 are rigidly connected to the upper ends of opposed, vertical legs 54. The lower ends of the legs 54 are insertable in the tubular legs 10, once the floor protecting caps 24*b* are removed and the legs 10 are arranged in a vertically upstanding posture. The elevation of the bar 18 above the datum plane 12 is controlled by elevating means in the form of a plurality of transverse, vertically periodic apertures which are disposed in the legs of the chinning bar in opposed, horizontally registering relation therebetween and associated cylindrical pins 56 which are selectively insertable within an aperture in each leg. The cylindrical pins 56, once inserted in horizontally registering apertures, serve to bear on the upper end of the leg in which the vertical leg of the chinning bar is inserted and thereby support the chinning bar at a desired elevation relative to the datum plane.

It can readily be appreciated at this point by the most casual reader that the exercising apparatus just described is highly stable and is fully self-supporting. Furthermore, though the structure is relatively small and portable, the base is sufficiently wide to minimize any tendency of the apparatus to tip. Assembly and disassembly is quite simple and the entire apparatus can be fully disassembled with minimal effort.

Referring now to FIG. 2, a horizontal cross-sectional view can be seen of a portion of the invention as taken along the line 2—2 of FIG. 1. As illustrated, a transverse member 34 is connected to an apertured collar 36 and braced relative thereto by flanges 42. The collar 36 closely surrounds a leg 10 having vertically periodic apertures 20 disposed therein. As indicated in connection with the discussion of FIG. 1, any apertures 40 of the collar are elliptical and register concurrently with a like number of apertures 20 disposed in the leg. The elliptical character of the apertures 40 assures registration between the apertures and easy insertion of the cylindrical fastener 38. The cylindrical fastener extends through an elliptical aperture 40 in the collar 36 through opposed apertures 20 in the leg, and finally protrudes outwardly from a second aperture 40 in the collar 36.

The end 58 protruding from the collar 36 is threaded to receive a wing nut 60 once washers 62 have been put in place and the cylindrical fastener has been inserted through the apertures. It should be recalled at this point that each collar 36 must be of sufficient length to allow the cylindrical fastener 38 to protrude therefrom and clear the transverse member 34 by a distance sufficient to allow the wing nut to be conveniently threaded onto the end 58 of the cylindrical fastener.

The end of the threaded fastener opposite the threaded end is characterized by a loop 64. The loop 64 is provided to allow manual grasping of the cylindrical fastener to facilitate insertion into or removal from the apertures and the threading and unthreading of the wing nut on the end 58 thereof.

Figure 3:
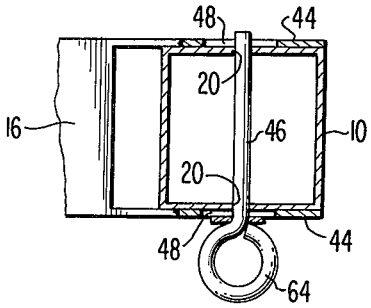
FIG. 3 illustrates a horizontal cross-sectional view of a portion of the invention as taken along the line 3—3 of FIG. 1.

Referring now to FIG. 3, a horizontal cross-sectional view can be seen of a portion of the invention as taken along the line 3—3 of FIG. 1. As illustrated, a yoke 44 is disposed at an end of an equipment supporting rail 16 and partially surrounds a leg 10 having a plurality of vertically periodic apertures 20. Elliptical apertures 48 in the yoke 44 register with the apertures 20 in the leg and, in conjunction with the cylindrical fastener 46, allow the rail to be adjustably and disconnectably connected to the leg at various desired elevations. The yoke is simply adjusted to the desired elevation so that the apertures 20 and 48 register and a cylindrical fastener 46 is inserted through the apertures. The elliptical character of the apertures 48 disposed in the yoke 44 insures registration and facilitates insertion and removal of the cylindrical fastener. The cylindrical fastener 46 in this case takes the form of a simple cylindrical pin, one end of which extends from the yoke 44, the other end having a loop 64 to facilitate handling of the pin.

Referring now to FIG. 4 of the drawings, a partial perspective view of an alternative embodiment of an element of the invention can be seen showing the portion of the invention intended to support the body of a user as pivotally connected to remaining portions thereof. As illustrated, opposed coplanar legs 10 having essentially coplanar caps 24*a* for engaging the datum plane or floor and vertically periodic apertures 20, are surrounded by apertured collars 36 which are interconnected through a transverse member 34. The apertures 40 of the apertured collars 36 are, of course, in registration with the apertures 20 in the leg and the cylindrical fasteners 38 are inserted therethrough to fix the collars longitudinally relative to the legs. An elongated padded platform 14 is shown pivotally connected to the transverse member 34.

The platform 14 is comprised of elongated structural cylinders 66 which have a suitable planar member 68 intercalated therebetween. The entire assembly is surrounded by a sheet of padding material 32 which encloses the platform to insure the comfort of a person resting on the platform. The platform 14 is pivotally connected to the transverse member by means of opposed, adjustable connecting means 70 which are pivotable about a horizontal axis indicated by the dashed line 72—72. The pivotable character of the connection permits vertical pivoting of the platform relative to the transverse member 34. Though the connecting means 70 will be more fully described in connection with the discussion of FIG. 5, it will be convenient to note here that the connecting means are formed by flanges projecting from the platform and the transverse member and pivotally interconnected by a bolt and wing nut arrangement which can be tightened to lock the connection. Such a pivotal connection is provided at both ends of the platform so that the platform is vertically pivotable relative to both transverse members.

As will be more clearly evident from the discussion of FIG. 8 to follow, if a user wishes to elevate one end of the platform 14 above the other for an exercise such as an inclined bench press or sit-up, he can simply loosen the bolts and associated wing nuts at both ends of the platform. The cylindrical fasteners 38 fixing the collars of the transverse members relative to the legs of a coplanar pair can be removed and the platform lifted to provide the desired inclination of the platform. Once the cylindrical fasteners are reinserted through horizontally registering apertures and the wing nuts 60 threaded back on the fasteners, the legs can be straightened to a vertical orientation if necessary by varying the length of the telescoping rails. The rails must change in length because if the platform is being moved, for instance, from a horizontal to an inclined orientation, the platform comes to form essentially the hypotenuse of a triangle and the original distance between the opposed coplanar pairs of legs is decreased. Thus the rails must shorten in length. Similarly if the platform is moved from an inclined orientation to a horizontal orientation, the distance between opposed coplanar pairs of legs increases and the rails must lengthen.

As can be readily appreciated from a comparison of FIGS. 8*d* and 8*e* or 8*i* and 8*j*, the pivotal connection of the platform to a transverse member provides a more stable configuration for the exercising apparatus. It will be readily appreciated that, if the connection of the platform to the transverse member is a rigid one, as in the case of the embodiment illustrated in FIG. 1, the elevation of one end of the platform above the other requires a complimentary inclination of the legs. This is an acceptable arrangement and is more simple than the pivotal arrangement; however, a user may prefer the pivotal connection since the legs do remain vertical and forces applied to the legs through the equipment supporting rail and the platform will act axially along the legs.

It is noteworthy, considering the alternative embodiment as a whole, that not only may the elevation and inclination of the platform be varied, but similarly the elevation and inclination of the rails can be varied both independently and in connection with an adjustment of the platform. The complete flexibility of the elevation and inclination of both the platform and the rails can therefore be readily understood to enhance the versatility of the exercising apparatus and to augment the number of exercises which can be conveniently performed using the exercising apparatus.

Referring now to FIG. 5, an exploded perspective view can be seen of the pivotal connection discussed in FIG. 4. As illustrated, one of the two structural cylinders 66 is connected to a transverse member 34 through the pivotal connecting means 70. More particularly it will be noted that opposed flanges 74 project from the structural cylinder 66 and the transverse member 34. A cylindrical aperture 76 extends through each of the flanges 74 and a threaded bolt 78 is inserted therethrough to link together the opposed flanges 74. The portion of the bolt 78 immediately adjacent the head 80 is not threaded to provide a smooth bearing surface 82 for the periphery of the cylindrical apertures 76. A wing nut 84 may be threaded onto the bolt 80 to clamp the flanges 74 together. If desired, the head 80 of the bolt 78 can be fastened to the flange so that the wing nut can be conveniently tightened and loosened by hand.

Annular, mating serrations 86 are disposed on abutting surfaces of the flanges 74. The serrations 86 should be sufficiently coarse to resist failure but also should be sufficiently fine to insure that the platform can be adjusted to any desired inclination. Once the inclination of the platform is adjusted as described in connection with the discussion of FIG. 4, the wing nut 84 can be tightened to clamp the mated serrations together and lock the flanges 74 relative to one another.

Referring now to FIG. 8 and more particularly to FIGS. 8*a*-8*j*, schematic representations of polymetric exercising methods according to the present invention can be seen. In each of the illustrations the legs 10 can be seen to be supporting the platform 14 and the equipment supporting rails 16. It must be emphasized at this point that the methods of exercising illustrated are exemplary only. A great many exercises can in fact be performed due to the versatility of the invention. The exercises which may be performed are characterized as polymetric to distinguish over isometric exercises which entail essentially static stressing of one's musculature without appreciable shortening of muscle fibre. Polymetric exercises, as will be seen, entail dynamic stressing of one's musculature and periodic shortening and lengthening of muscle fibre. This is not to say that the exercising apparatus of the present invention cannot be used for performing isometric exercises, but rather that it is most useful for and is intended to function in connection with polymetric exercises.

One example of a method of exercising can be seen by referring to FIG. 8*a* wherein an exercise commonly referred to as a bench press is schematically illustrated. This type of exercise is used to exercise the musculature of one's chest and arms. The platform and rails are positioned relative to one another so that when a person rests in a supine posture on the platform, the rails are just above the level of his chest. The barbells 88 initially rest on the rails 16 above the chest of the user so that he can conveniently grasp the bar of the barbells and cyclically raise and lower the weights. When the exercising routine has been completed, the user can return the barbells 88 to the rails and remove himself from the platform. It will be appreciated that although the rails are used primarily to support the barbells, the rails also serve to protect the user should the bar of the barbells slip from his grasp or should he be unable to push the barbells away from his chest.

After appropriately raising the rails and/or platform, an excerising routine often referred to as power squats can be performed as illustrated in FIG. 8*b*. This exercise is intended to develop the musculature of one's back and legs. The rails are positioned at a level slightly below the shoulder level of the user of the exercising apparatus at the deepest point of a squat and the barbells are positioned on the rails. The user can now straddle the platform 14. Since one's legs are normally spread during this type of exercise and because the platform is rather narrow, the need to straddle the platform presents no significant inconvenience. Once the user has straddled the bench and assumed a squatting position, he positions the barbell on his shoulders by grasping the bar of the barbell and holding the barbell against his shoulders near the nape of his neck. He next extends his legs to stand erect and then cyclically bends his knees to lower and raise his body to perform the power squat exercising routine.

Without making any adjustmennt whatever from the arrangement of the platform and rails used for the power squat routine illustrated in FIG. 8*b*, a sit-up exercising routine of the type illustrated in FIG. 8*c* can be performed in order to exercise the musculature of one's stomach and thighs. To perform this exercise the user of the exercising apparatus simply inverts the apparatus from the normal position illustrated in FIG. 8*b* 180° relative to the datum plane, and balances a loaded barbell on the platform which is now above the rails. The caps 24*b* of the second means for engaging a ground surface now engage the datum plane. The user rests in a supine position on the bench, hooking his feet or ankles under one of the transverse members or through suitable stirrups. He then positions himself and the weights so that the weights contact his shoulders in a manner similar to that characterizing the exercise illustrated in 8*b*. The user then grasps the bar of the barbell and cyclically raises and lowers his body to and from a sitting position. Alternatively, a user can simply place stacks of the weighted discs or plates of a barbell together on the platform and pad the stack with a towel or other similar material. He can then rest his body in a supine position with his feet or ankles under one of the transverse members or through suitable stirrups and position the weights under his head. The user can then grasp the plates, holding them against the back of his head, and cyclically raise and lower his body to and from a sitting position as described earlier.

It should be emphasized that no adjustment of the rails or platform was required. The user simply inverts the apparatus from the normal position illustrated in FIG. 8*b* to the inverted position of 8*c* 180° relative to the datum plane upon which the apparatus rests. Indeed even the inversion of the apparatus is unnecessary if a stack of plates rather than the entire barbell is used. The particular arrangement used would, of course, depend upon the preference of the user.

Again without adjusting the arrangement of the platform and rails, the exercise routine illustrated in FIG. 8*g* can be performed. This exercise is commonly referred to as a rowing exercise and is used to develop the musculature of one's chest and upper arms. If this exercise can be conducted immediately after the exercise illustrated in FIG. 8*b* or, if the exercise is performed after that illustrated in FIG. 8*c* and the exercise apparatus has not already been inverted, after the exercising apparatus has been inverted from the normal position illustrated in FIG. 8*b* to a position reoriented 180° relative to the datum plane so that the caps 24*b* of the second means for engaging a ground surface engage the datum plant. Once the apparatus is inverted, the barbells 88 can be rested upon the rails and the user can rest in a prone position on the bench 14, extending his arms downwardly to grasp the bar of the barbell. Once the bar of the barbell has been grasped, the user can cyclically move the weights toward and away from his chest to perform the exercising routine.

As will be seen in the course of further discussion, other exercises can be performed without adjusting the exercising apparatus. For example, the exercises illustrated in FIGS. 8*l* and *m* can be performed. It should nonetheless be clear at this point that the exercising apparatus provided is highly versatile in that numerous exercises can be conveniently performed without the need for time consuming adjustment of the exercising apparatus. This versatility is amplified by the invertible character of the exercising apparatus.

A further example of the versatility of the exercising apparatus can be seen by referring to FIG. 8*d* wherein the exercising apparatus is normally oriented with the caps 24*a* of the first means for engaging a ground surface engaging the datum plane. The bench has been inclined as described earlier so that an exercise often termed an inclined bench press can be performed to develop the musculature of one's upper chest and shoulders. In the embodiment illustrated in FIG. 8*d*, the transverse members are rigidly connected to the platform. The independent adjustment of the opposite ends of the platform upwardly and downwardly along the length of the coplanar pairs of legs results in the inclination of both the platform and the legs relative to the datum plane. Because of the telescoping character of the rails however, they lengthen to remain horizontal and thus form what may be considered to be essentially the hypotenuse of a triangle formed by the legs 10, the rails 16, and the platform 14. The rails are adjusted to position the barbells resting thereon just above the chest of the user as in the case of the bench press exercise illustrated in FIG. 8*a*. The user can then rest his body on the platform, grasp the bar of the barbell, and cyclically move the barbell away from and toward his chest to perform the exercising routine.

If the person exercising wishes to perform an inclined sit-up using a barbell to develop his stomach and thighs, he can simply invert the exercising apparatus from the normal position illustrated in FIG. 8*d* to reorient it 180° relative to the datum plane so that the caps 24*b* of the second means for engaging a ground surface again engage the datum plane as illustrated in FIG. 8*i*. As indicated in connection with the discussion of FIG. 8*c*, the barbell is rested on the platform 14 and the user rests his body on the platform with his head down and his feet or ankles either under the transverse member or inserted through suitable stirrups. As in the case of the exercise illustrated in FIG. 8*c*, the user next grasps the bar of the barbell and holds it against his shoulders behind his neck while cyclically sitting up and reclining as described earlier in connection with FIG. 8*c*.

These same exercises involving the inclined bench press and sit-up routine could be performed if the platform were connected to the transverse members through the serrated, pivotal connections discussed in connection with FIGS. 4 and 5. In this regard it can be seen from an examination of FIG. 8*e* that, by loosening the wing nuts of the serrated connectors, independently adjusting opposed ends of the platform along the legs, and then retightening the wing nuts, the legs remain in a highly stable, vertically upright orientation while the platform rotates vertically to assume a posture which might be characterized as forming the hypotenuse of a triangle. The rails remain horizontal and are thus shortened by means of the telescoping capability described earlier. The exercise illustrated in FIG. 8*e* is then otherwise performed in a manner identical to that described in connection with the discussion of FIG. 8*d*. Similarly, after inverting the exercising apparatus, a sit-up exercise of the type illustrated in FIG. 8*j* could be performed as described in connection with the discussion of FIG. 8*i*.

The versatility of the exercising apparatus allows numerous other exercises to be performed. For instance, chin-ups can be performed as illustrated in FIG. 8*f* to develop the musculature on one's chest and arms. The chinning bar 18 is positioned to a desired height as described in connection with the discussion of FIG. 1, the actual height depending upon the height of the user and the elevation of the platform 14. Because the bar 18 extends diagonally across the platform 14, a user hanging from the bar will be suspended over essentially the center of the apparatus and the exercising apparatus will remain quite stable. A user will normally stand on the bench and either reach up or jump up to grasp the bar. Once the bar has been grasped, the user can cyclically raise and lower his body to perform the chinning exercise.

The exercising routine illustrated in FIG. 8*h* affords an exercise for developing the musculature of one's back, arms, and chest. The user rests his body in a prone position on the platform 14 and, grasping a dumbbell 90 in each hand smoothly swings his arms laterally into a horizontal orientation. The user holds his arms in the horizontal orientation momentarily and then returns them to the vertical position, cyclically repeating these movements until the routine has been completed.

Referring now to FIG. 6, a perspective view can be seen of an embodiment of an element of the invention intended to be lifted by a user in the course of performing exercising routines. The exercising apparatus is used to carry disc weights of the type forming a part of a barbell or dumbbell and will, for convenience, be referred to as a chandelier. The chandelier is comprised of a vertical central column 92 to the lower end of which a plurality of supportive members 94 is connected. The supportive members radiate from the central column in a coplanar array and each support an upstanding retaining means in the form of a slender column 96. The retaining columns 96 are vertically oriented relative to the supportive members and are parallel to the central column. The retaining columns 96 serve to retain the disc weights placed over the columns in fixed positions relative to the central column so that a user can conveniently lift the chandelier. Leveling means in the form of planar discs 98 may be intercalated between each supportive member and each vertical retaining column to maintain the disc weights in flat orderly stacks.

Lifting means in the form of an elongated tether 100, harness 102 and adjustable connection 104 is connected to the central column 92 to allow a user to lift the exercising apparatus. The tether can be composed of any suitable material which is sufficiently strong to suspend the loaded chandelier and in which periodic closed loops 106 can be formed. Thus a knotted rope or chain could be used. The tether is adjustably connected to the central column by a suitable cylindrical fastener 108 which passes transversely through a first aperture 110 in a cylindrical portion of the central column, through a selected loop 106 in the tether, and through a second aperture 112 in the central column. The cylindrical fastener is secured within the apertures in any desired manner and the length of the tether is varied in accordance to the loop selected.

The end of the tether 100 opposite the adjustable connection 104 takes the form of a harness 102 intended to depend from the body of a user during an exercising routine. In the embodiment illustrated, the harness takes the form of a padded handle formed by a loop in the tether. If the harness takes the form of a padded handle, the portion of the tether constituting the loop may be covered with a hard core of material such as vinyl and the core may be tightly wrapped with a soft material so that the handle can be comfortably grasped by the user. Other harnesses may also be used. For instance, a head harness of the type which depends from the head of a user during neck exercises could be used. It will thus be readily appreciated, in light of the adjustable character of the tether and the variety of harnesses which can be used, that the chandelier is a highly versatile exercising apparatus. It should also be pointed out that the exercising apparatus is highly convenient since the disc weights from a barbell or dumbbell can be conveniently loaded on the chandelier without detaching the tether from the central column. Another advantage of the chandelier is that it stands upright by itself for the convenience of loading, unloading, rope length adjustment, and better handling. It also has four plate stacks so that hundreds of pounds of weights do not stack several feet off the floor but are in short orderly stacks.

Referring now to FIG. 7, a partial sectional view of the invention can be seen as taken along lines 7—7 of FIG. 6. As illustrated, the elongated tether 100 is connected through the cylindrical fastener 108 to the cylindrical portion of the central column 92. The cylindrical fastener 108 extends transversely through the first and second apertures mentioned in connection with the discussion of FIG. 6 and in the process extends through a selected loop of a series of closed loops 106 disposed along the tether. The tether in this case is formed from a double strand of material periodically knotted as at 114 to form the closed loops 106. A double stranded length of material such as this could also be formed into periodic loops by means of appropriate clips which could be employed to tightly clamp the strands together at periodic points along the length thereof to form the closed loops. Similarly a length of chain could be used and the cylindrical fastener could be inserted through various links in the chain. The closed loops, in conjunction with the cylindrical member, allow the tether to be connected at diverse points along the length thereof and therefor afford an adjustable connection between the harness and the central column. The adjustable connection allows for considerable diversity both with regard to the physical characteristics of the user and the exercises which may be performed. This versatility can be more clearly seen upon examination of FIGS. 8*k*–8*n* and consideration of the accompanying discussion.

Referring again to FIG. 8 and more particularly to FIGS. 8*k*–8*n*, schematic representations can be seen of polymetric exercising methods according to the present invention which may be employed to develop the musculature and maintain the physical fitness of a user. In FIG. 8*k* is illustrated an exercise commonly referred to as a cable curl which is used to develop the musculature of one's arm and chest. This exercise could be conducted immediately after the exercise discussed in connection with FIG. 8*h* without any adjustment of the body and equipment supportive element of the exercising apparatus. In this exercise the chandelier 116 is loaded with disc weights from a barbell or a dumbbell by placing the weights over the vertical retaining columns. The length of the tether 100 is adjusted to an appropriate length as described earlier and the user grasps the harness, which in this case takes the form of a padded handle. Resting his elbow on the platform 14, the user performs the exercising routine by cyclically raising and lowering his forearm while standing to one side of the platform.

The exercise illustrated in FIG. 8*l* can be conveniently performed after performing the sit-ups illustrated in FIG. 8*c* with no adjustment of the body or equipment supportive element of the exercising apparatus. The chandelier is loaded as desired and the length of the tether adjusted as necessary. The user rests his body in a supine posture on the platform and fits a suitable head harness 102 over the crown of his head. Any suitable commerically available head harness can be employed and such a harness is normally comprised of a strap arrangement which is fitted on the user's head somewhat like a cap. The weights are connected to the harness through the tether and a user can perform the exercising routine by cyclically moving his head to raise and lower the weights. Instead of a supine position the user can also rest in a prone position or rest on either of his sides to exercise different muscles of his neck.

By replacing the head harness mentioned in connection with the discussion of FIG. 8*l* with a padded handle and adjusting the length of the tether, the exercise illustrated in FIG. 8*m* can be performed. This exercise is commonly referred to as a bear hug and is employed to develop the musculature of one's chest, back, and upper arms. The chandelier is loaded as desired and the user rests in a prone position on the platform grasping the handles 102 with both hands. The user then cyclically lifts the harness, touching his hands to the underside of the platform. It should again be noted that no adjustment is necessary to the body or equipment supportive element of the exercising apparatus and the bear hug exercising routine could be performed after the routines illustrated in FIG. 8*c*, 8*l*, or 8*g*.

Again, with no further adjustment of the body or equipment supportive element of the exercising apparatus, the exercise illustrated in FIG. 8*n* could be performed. This exercising routine is commonly referred to as a leg extensor exercise and is used to develop the musculature of one's thigh and to strength the ligaments and tendons around one's knees. The chandelier 116 is loaded as desired and any necessary adjustment to the length of the tether is made. The user rests in a supine position on the platform 14 with his lower leg extending from the knee beyond the end of the platform. Slipping one of his feet through the loop formed by the harness 102 and grasping the platform or transverse member, the person using the apparatus can perform the leg extensor routine by cyclically extending his leg and bending his knee to raise and lower the chandelier. This routine can then be repeated using the other leg.

The extraordinary versatility of the invention can now be readily appreciated. It can be understood from the discussion of FIG. 8 that any number of specific sequences of routines could be devised by a person using the exercising methods apparatus presented in the preceding. The routines selected and the order of the routines within the sequence depends in part on the areas of one's body requiring exercise and a person's particular preferences. In any case, by virtue of the versatility of the invention, the routines can be arranged in a sequence wherein the time lost by adjusting the exercising apparatus is minimized. Furthermore, the versatility of the apparatus allows it to replace the various pieces of equipment mentioned during the discussion of the background of the invention.

The user for example might begin a sequence of routines with the power squats illustrated in FIG. 8*b* to exercise his legs and back. He could follow this routine with the sit-up routine illustrated in FIG. 8*c* to develop his stomach muscles, inverting the apparatus if he wished so that the platform would be elevated above the rails. Once the apparatus is inverted one could perform either the rowing exercise illustrated in 8*g* to develop his chest and arms or he could perform the neck exercise of FIG. 8 l. He could next perform either the bear hug routine illustrated in FIG. 8*m* to develop his chest and arms or the leg extensor routine illustrated in FIG. 8*n*. One might next prefer to perform the cable curl illustrated in FIG. 8*k* or the exercise illustrated in 8*h* to develop his back, arms, and chest. It should be noted that the sequence of routines just described can be performed without ever adjusting the body and equipment supportive element of the exercising apparatus in any way other than to invert it. A user of the exercising apparatus could also continue exercising and perform any of the remaining exercises illustrated in FIG. 8 or any of a great many others.

SUMMARY OF MAJOR ADVANTAGES

It will be appreciated that in providing exercising methods and apparatus according to the present invention certain significant advantages are obtained.

Of particular importance is the advantage that the exercising apparatus is highly versatile and convenient and is amenable to use in connection with exercises performed by a person while in a standing, prone, supine, sitting, or suspended posture.

It is a further significant advantage of the invention that the equipment used is sufficiently stable that it is self-supporting and need not be fixed to the floor or ceiling of the room in which it is used.

Another advantage of the invention is that it is readily portable and easily disassembled if it is to be taken out of use and stored or moved.

An additional advantageous quality of the invention resides in the fact that it is compact and quite simple in construction and operation.

In describing the invention, reference has been made to a preferred embodiment. However, those skilled in the art and familiar with the disclosure of the invention may recognize additions, deletions, substitutions, or other modifications which would fall within the purview of the invention as defined in the claims.

What is claimed is:

1. An invertable exercising apparatus for polymetrically developing the musculature and maintaining the physical fitness of a user, said apparatus comprising:

upstanding, mutually parallel, elongated legs operable to rest upon a datum plane and arranged in opposed, coplanar pairs to coincide with apices of a circumscribing rectangle;

body supporting means having opposed ends and being adjustably and disconnectably connected along the length of said legs for supporting the body of the user at selected elevations and orientations relative to said datum plane;

equipment supporting means having opposed ends and being adjustably and disconnectably connected along the length of said legs for supporting at selected elevations relative to said datum plane equipment to be manipulated by the user;

first connecting means connected to said body supporting means for independently adjustably and disconnectably connecting said opposed ends of said body supporting means to selected locations along the length of said legs of said opposed, coplanar pairs to rigidly maintain said body supporting means in a selected spatial and orientational relation with said equipment supporting means during the performance of a first exercising routine by a user, and for continuously resisting movement of said body supporting means relative to said legs in both vertical directions therealong;

second connecting means connected to said equipment supporting means for independently adjustably and disconnectably connecting said opposed ends of said equipment supporting means to selected locations along the length of said legs of said opposed, coplanar pairs to rigidly maintain said equipment supporting means in a selected spatial and orientational relation with said body supporting means, and for continuously resisting movement of said equipment supporting means relative to said legs in both vertical directions therealong; and first and second ground engaging means for alternately and independently supporting said legs in first and second positions invertably by 180° relative to one another;

said first engaging means being carried in a generally coplanar posture by first coplanar extremes of said legs to support said legs in said first position independently of said second ground engaging means while said body supporting means and said equipment supporting means are maintained in said selected spatial and orientational relation by said first and second connecting means;

said second ground engaging means being carried in a generally coplanar posture by second coplanar extremes of said legs to support said legs independently of said first ground engaging means with said exercising apparatus being inverted 180° relative to the datum plane and without altering said selected spatial and orientational relation between said body supporting means and said equipment supporting means which is being continually maintained by said first and second connecting means;

said body supporting means comprising an elongated platform having top and bottom user-supporting surfaces both of which being padded to protect the user during use of the apparatus in either of its first and second positions.

2. An exercising apparatus as defined in claim 1 wherein said first connecting means comprises:

a transverse member orthogonally and rigidly connected to each end of said body supporting means; and a collar rigidly connected to each end of each transverse member, and relatively closely and fully surrounding a portion of one leg of a coplanar pair of legs in sliding relation therewith to render each end of said body supporting means independently movable along the legs of the coplanar pair to incline said body supporting means at selected angles relative to the datum plane while concurrently rigidly resisting relative rotational movement between said body supporting means and said legs.

3. An exercising apparatus as defined in claim 2 wherein said first connecting means further comprises:

a plurality of transverse, vertically periodic, essentially circular apertures disposed in and passing entirely through each leg in opposed, laterally registering relation between said legs;

essentially elliptical apertures disposed in and passing entirely through each of said collars, said apertures being vertically spaced to register concurrently with apertures disposed in said leg surrounded by said collar; and elongated cylindrical members each insertable through said apertures in registration entirely through a collar and a leg surrounded thereby.

4. An excerising apparatus as defined in claim 2 wherein:

said equipment supporting means comprises laterally spaced, parallel rails extending independently and individually between coplanar legs of opposed coplanar pairs;

adjacent ends of said rails are connectable by said second connecting means to one of said coplanar pairs of legs at an elevation thereof below the connection therewith of said body supporting means; and the remaining ends of said rails are connectable by said second connecting means to the other of said coplanar pairs of legs at an elevation thereof above the connection therewith of said body supporting means.

5. An exercising appartus as defined in claim 4 wherein said second connecting means comprises:

a yoke disposed at each end of each rail of said equipment supporting means to partially surround a leg and connect said rail to said leg;

said plurality of transverse, vertically periodic, essentially circular apertures disposed in each leg;

generally elliptical, transverse apertures in each of said yokes, said elliptical apertures being located in said yokes to register with said transverse, vertically periodic apertures; and cylindrical pins insertable through said apertures in registration.

6. An exercising apparatus as defined in claim 5 wherein:

said rails are each longitudinally telescoping in response to changes in the distance between coplanar pairs of legs incident to adjustment of the position of said body supporting means relative thereto and remain horizontal to the datum plane.

7. An exercising apparatus as defined in claim 4 wherein said coplanar legs are tubular and further comprising:

a horizontally oriented bar extending between and connected to diagonally opposed, coplanar legs, the remaining of said legs being rigidly connected to and laterally offset from said opposed, coplanar legs by said body supporting means and said first connecting means to stabilize said bar during use in the performance of an exercise;

vertical legs rigidly connected at the upper ends thereof to opposed ends of said horizontally oriented bar, the lower ends thereof being at least partially insertable within the upper portions of said tubular, coplanar legs;

a plurality of transverse, vertically periodic apertures disposed in each of said vertical legs in opposed, horizontally registering relation between said legs; and a pair of cylindrical pins each selectively insertable within an aperture of one of said vertical legs to bear against the uppermost portion of said tubular leg receiving said one vertical leg to support said horizontally oriented bar at a desired elevation.

8. An exercising apparatus as defined in claim 1 wherein:

one end of said equipment supporting means is connectable by said second connecting means to one of said coplanar pairs of legs at a point thereof below the point of connection therewith of said body supporting means, with the remaining of said equipment supporting means being connectable by said second connecting means to the other of said coplanar pairs of legs at a point thereof above the point of connection therewith of said body supporting means, so that said body supporting means extends through the plane defined by said equipment supporting means.

9. An invertable exercising apparatus for polymetrically developing the musculature and maintaining the physical fitness of a user, said apparatus comprising:

upstanding, mutually parallel, elongated legs operable to rest upon a datum plane and arranged in opposed, coplanar pairs to coincide with apices of a circumscribing rectangle;

body supporting means having opposed ends and being adjustably and disconnectably connected along the length of said legs for supporting the body of the user at selected elevations and orientations relative to said datum plane;

equipment supporting means having opposed ends and being adjustably and disconnectably connected along the length of said legs for supporting at selected elevations relative to said datum plane equipment to be manipulated by the user;

first connecting means connected to said body supporting means for independently adjustably and disconnectably connecting said opposed ends of said body supporting means to selected locations along the length of said legs of said opposed, coplanar pairs to rigidly maintain said body supporting means in a selected spatial and orientational relation with said equipment supporting means during the performance of a first exercising routine by a user, and for continuously resisting movement of said body supporting means relative to said legs in both vertical directions therealong;

second connecting means connected to said equipment supporting means for independently adjustably and disconnectably connecting said opposed ends of said equipment supporting means to selected locations along the length of said legs of said opposed, coplanar pairs to rigidly maintain said equipment supporting means in a selected spatial and orientational relation with said body supporting means during the performance of a first exercising routine by a user, and for continuously resisting movement of said equipment supporting means relative to said legs in both vertical directions therealong;

first means for engaging a ground surface, said first engaging means being carried in a generally coplanar posture by first coplanar extremes of said legs to engage the datum plane upon which said legs rest during said first exercising routine conducted while said body supporting means and said equipment supporting means are maintained in said selected spatial and orientational relation by said first and second connecting means;

second means for engaging a ground surface, said second engaging means being carried in a generally coplanar posture by second coplanar extremes of said legs to engage the datum plane upon which said legs rest during a second exercising routine conducted after said exercising apparatus has been inverted and thus reoriented 180° relative to the datum plane and without altering said selected spatial and orientational relation between said body supporting means and said equipment supporting means being continually maintained by said first and second connecting means;

said first connecting means comprising:

a transverse member orthogonally and rigidly connected to each end of said body supporting means; and a collar rigidly connected to each end of each transverse member, and relatively closely and fully surrounding a portion of one leg of a coplanar pair of legs in sliding relation therewith to render each end of said body supporting means independently movable along the legs of the coplanar pair to incline said body supporting means at selected angles relative to the datum plane while concurrently rigidly resisting relative rotational movement between said body supporting means and said legs; and said first connecting means further comprising opposed, adjustable connecting means for connecting said body supporting means to each of said transverse members in vertically pivotable relation therewith, said adjustable connecting means being releasable to pivot about a horizontal axis as an end of said body supporting means is moved vertically along a coplanar pair of legs relative to the remaining end and thereafter lockable to maintain said body supporting means at a selected spatial and orientational relation to the datum plane and to concurrently maintain said legs in a vertical orientation.

10. An invertable exercising apparatus for polymetrically developing the musculature and maintaining the physical fitness of a user, said apparatus comprising:

upstanding, mutually parallel, elongated legs operable to rest upon a datum plane and arranged in opposed, coplanar pairs to coincide with apices of a circumscribing rectangle;

body supporting means having opposed ends and being adjustably and disconnectably connected along the length of said legs for supporting the body of the user at selected elevations and orientations relative to said datum plane;

equipment supporting means having opposed ends and being adjustably and disconnectably connected along the length of said legs for supporting at selected elevations relative to said datum plane equipment to be manipulated by the user;

first connecting means connected to said body supporting means for independently adjustably and disconnectably connecting said opposed ends of said body supporting means to selected locations along the length of said legs of said opposed, coplanar pairs to rigidly maintain said body supporting means in a selected spatial and orientational relation with said equipment supporting means during the performance of a first exercising routine by a user, and for continuously resisting movement of said body supporting means relative to said legs in both vertical directions therealong;

second connecting means connected to said equipment supporting means for independently adjustably and disconnectably connecting said opposed ends of said equipment supporting means to selected locations along the length of said legs of said opposed, coplanar pairs to rigidly maintain said equipment supporting means in a selected spatial and orientational relation with said body supporting means during the performance of a first exercising routine by a user, and for continuously resisting movement of said equipment supporting means relative to said legs in both vertical directions therealong;

first means for engaging a ground surface, said first engaging means being carried in a generally coplanar posture by first coplanar extremes of said legs to engage the datum plane upon which said legs rest during said first exercising routine conducted while said body supporting means and said equipment supporting means are maintained in said selected spatial and orientational relation by said first and second connecting means;

second means for engaging a ground surface, said second engaging means being carried in a generally coplanar posture by second coplanar extremes of said legs to engage the datum plane upon which said legs rest during a second exercising routine conducted after said exercising apparatus has been inverted and thus reoriented 180° relative to the datum plane and without altering said selected spatial and orientational relation between said body supporting means and said equipment supporting means being continually maintained by said first and second connecting means;

said first connecting means comprising:

a transverse member orthogonally and rigidly connected to each end of said body supporting means; and a collar rigidly connected to each end of each transverse member, and relatively closely and fully surrounding a portion of one leg of a coplanar pair of legs in sliding relation therewith to render each end of said body supporting means independently movable along the legs of the coplanar pair to incline said body supporting means at selected angles relative to the datum plane while concurrently ridigly resisting relative rotational movement between said body supporting means and said legs;

said equipment supporting means comprising laterally spaced, parallel rails extending independently and individually between coplanar legs of opposed coplanar pairs;

adjacent ends of said rails being connectable by said second connecting means to one of said coplanar pairs of legs at an elevation thereof below the connection therewith of said body supporting means; and the remaining ends of said rails being connected by said second connecting means to the other of said coplanar pairs of legs at an elevation thereof above the connection therewith of said body supporting means;

said rails each being longitudinally telescoping in response to changes in the distance between coplanar pairs of legs incident to adjustment of the position of said body supporting means relative thereto and remain horizontal to the datum plane;

said body supporting means comprising an elongated, padded platform of a width less than the width of the back of a typical user measured between the shoulder joints of said typical user, said platform being fully padded about the exterior thereof to protect the back of a user when used in either a normal orientation or an inverted orientation.

* * * * *